US005896586A

United States Patent [19]

Freund

[11] Patent Number: 5,896,586

[45] Date of Patent: Apr. 27, 1999

[54] ADJUSTABLE HEADBAND HAVING A RESILIENTLY BOWABLE FASTENER SURFACE

[75] Inventor: Paul X. Freund, Cranberry, Pa.

[73] Assignee: Mine Safety Appliances Company, Pittsburgh, Pa.

[21] Appl. No.: 08/839,496

[22] Filed: Apr. 14, 1997

[51] Int. Cl.[6] ..... A42B 3/14

[52] U.S. Cl. ..... 2/418; 2/416; 2/DIG. 11

[58] Field of Search ..... 2/416, 417, 418, 2/419, 420, 421, 410, 183, 195.1, 195.2, 195.4, DIG. 11, 8; 24/16 PB

[56] References Cited

U.S. PATENT DOCUMENTS

| | | | |
|---|---|---|---|
| 3,156,922 | 11/1964 | Anderson | 2/419 |
| 3,500,474 | 3/1970 | Austin | 2/8 |
| 3,696,442 | 10/1972 | Amundsen et al. | 2/8 |
| 4,951,362 | 8/1990 | Denemark et al. | 24/16 PB |
| 5,346,479 | 9/1994 | Schneider | 24/16 PB |

*Primary Examiner*—Michael A. Neas

*Attorney, Agent, or Firm*—James G. Uber; Henry E. Bartony, Jr.

[57] ABSTRACT

The present invention provides an adjustable, flexible headgear band. The band comprises a first end and a second end which overlap. The first end comprises a plurality of longitudinally spaced slots therein. The second end comprises a resilient fastener formed integrally with the second end. The resilient fastener comprises a channel to slidably receive the first end in overlapping engagement with the second end. The fastener comprises a fastener surface from which at least one flange extends to engage and be seated in one of the plurality of slots of the first end. The fastener surface is resiliently bowable in a direction away from the first end upon application of compressive force to the fastener. Upon application of such compressive force, the at least one flange is unseated from the slot in which it is seated so that the first end can be slid relative to the fastener (and thereby the second end). The second end further comprises at least one latitudinally extending notch adjacent the fastener to facilitate bowing of the fastener surface. Preferably, two such notches are provided, one extending from the top of the second end toward the center thereof, and one extending from the bottom of the second end toward the center thereof.

19 Claims, 6 Drawing Sheets

ADJUSTABLE HEADBAND HAVING A RESILIENTLY BOWABLE FASTENER SURFACE

FIELD OF THE INVENTION

The present invention relates to a headband for headgear and particularly to a headband for protective headgear such as a protective helmet in which the circumference or size of the band is easily adjusted without removing the helmet.

BACKGROUND OF THE INVENTION

Most types of protective headgear worn by workers to protect them from falling objects have a suspension system. The suspension system, along with the helmet itself, act to absorb the shock of a falling object striking the worker's head. The suspension system is also used to hold the helmet on the worker's head.

The suspension is often a web-like support system comprising two or more strips of material that are arranged to cross each other. The ends of the strips are, for example, attached at four or more points around the circumference of the helmet. A band is then typically attached to the four or more points of the suspension to permit the helmet to be worn by the worker. To securely position the helmet on the worker's head, it is essential that the circumference of the headband be adjustable to fit the appropriate head size. A napestrap is often attached at one end of the band to achieve these results.

In the Staz-On® Suspension, currently available from Mine Safety Appliances Company of Pittsburgh, Pa., and described in U.S. Pat. No. 3,500,474, the disclosure of which is incorporated herein by reference, a headband, and more particularly, the napestrap position of the headband, is manually adjusted by the wearer to fit the appropriate head size. The two ends of the band are connected and held in place by a slot-and-teeth arrangement. One end of the band is formed with parallel rows of flanges or teeth. The other end of the band is formed with parallel rows of slots. The size of the band can be adjusted by inserting the teeth of one end of the strap into the slots formed in the other end of the strap at the desired length. Although this type of band is relatively simple in design and manufacture (in part because separate mechanical fasteners or adjustment mechanisms are generally not required), users of such bands often have difficulty adjusting the band size while wearing the suspension. This inconvenience often results in the use of a different, more expensive type of suspension, such as a ratchet-type suspension systems, for example, the Fas-Trak® Suspension, currently available from Mine Safety Appliances Company of Pittsburgh, Pa., and described in U.S. Pat. No. 4,942,628.

It would be desirable, therefore, to develop a headband for protective headgear which is not only easily adjustable while being worn by the user, but which is also simple and inexpensive to manufacture.

SUMMARY OF THE INVENTION

Generally, the present invention provides a flexible, adjustable, headband for headgear. The headband of the present invention is particularly well suited for use with protective headgear. The band comprises a first end and a second end which overlap. The first end comprises a plurality of longitudinally spaced attachment members. Preferably, these attachment members comprise retention regions. These retention regions can, for example, be depressions, recesses or preferably slots. The second end comprises a resilient fastener, preferably formed integrally with the second end. The resilient fastener comprises an opening, preferably a channel, to slidably receive the first end in overlapping engagement with the second end. The fastener comprises a fastener surface comprising at least one cooperating attachment member to cooperate with the attachment members of the first end of the band. Preferably, the fastener surface comprises at least one protrusion which extends to engage and be seated in one of a plurality of retention regions of the first end. In an alternative embodiment, the attachment members of the band can comprise a plurality of protrusions adapted to engage and be seated in at least one retention region in the fastener surface of the fastener.

The fastener surface is resiliently bowable in a direction away from the first end upon application of compressive force to the fastener. Upon application of such compressive force, the attachment member of the first end of the band and the cooperating attachment member of the fastener disconnect so that the first end can be slid relative to the fastener (and thereby the second end). In a preferred embodiment, the at least one protrusion member of the fastener is displaced from the retention region in which it is seated so that the first end can be slid relative to the fastener. The second end further comprises at least one latitudinally extending notch adjacent the fastener to facilitate bowing of the fastener surface. Preferably, two such notches are provided, one extending from the top of the second end toward the center thereof, and one extending from the bottom of the second end toward the center thereof. Preferably, the two notches are opposite each other.

DETAILED DESCRIPTION OF THE INVENTION

Figure 1:
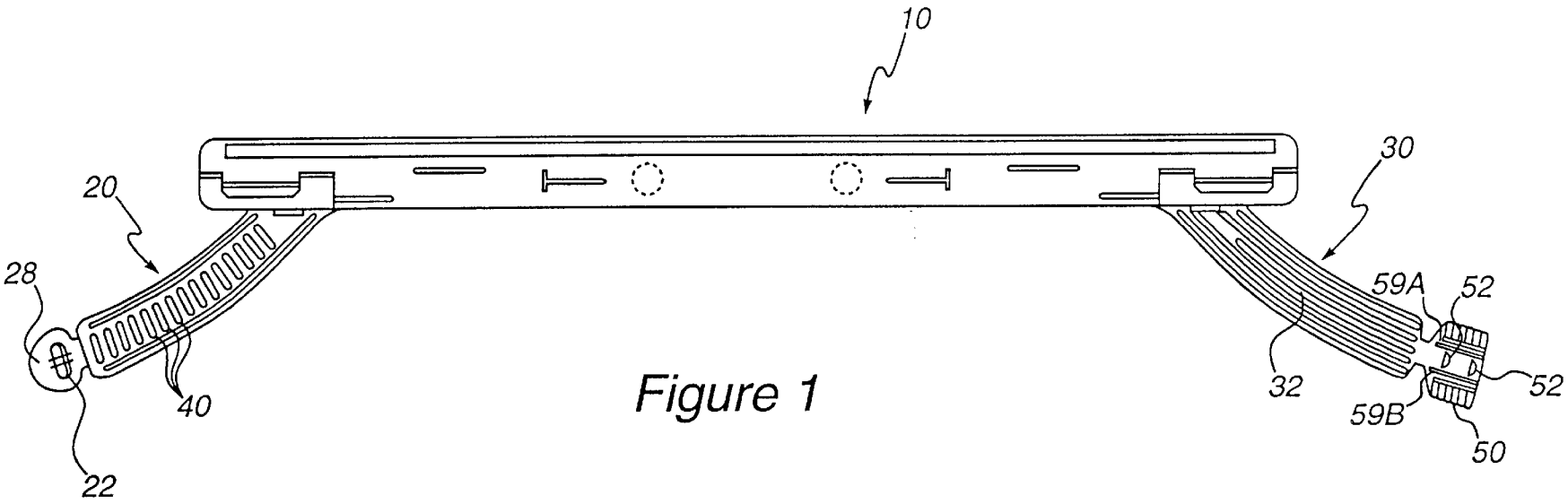
FIG. 1 illustrates one embodiment of a headband of the present invention laid flat with the first end and the second end thereof disconnected.

Band 10 is a flexible member that may be molded from an integral piece of a suitable polymeric material to extend around the head of the user. First end 20 and second end 30 preferably overlap at the back of the head. Band 10 may be straight from end to end, in which case first end 20 and second end 30 will overlap on the head of the user. First end 20 and second end 30 may, on the other hand, extend downward in the rear portion of band 10 across the nape of the neck. This embodiment is illustrated in FIG. 1. Regardless of which type of band 10 is used, overlapping ends 20 and 30 are connected in the same manner.

Figure 2:
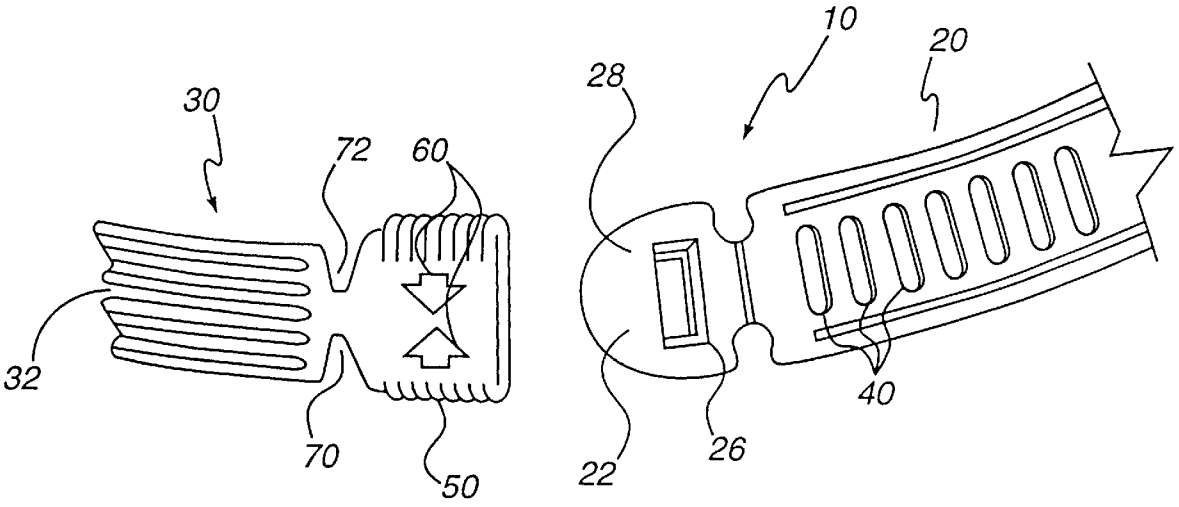
FIG. 2 illustrates a rear view of the first end and second end of the headband disconnected from each other.
Figure 3:
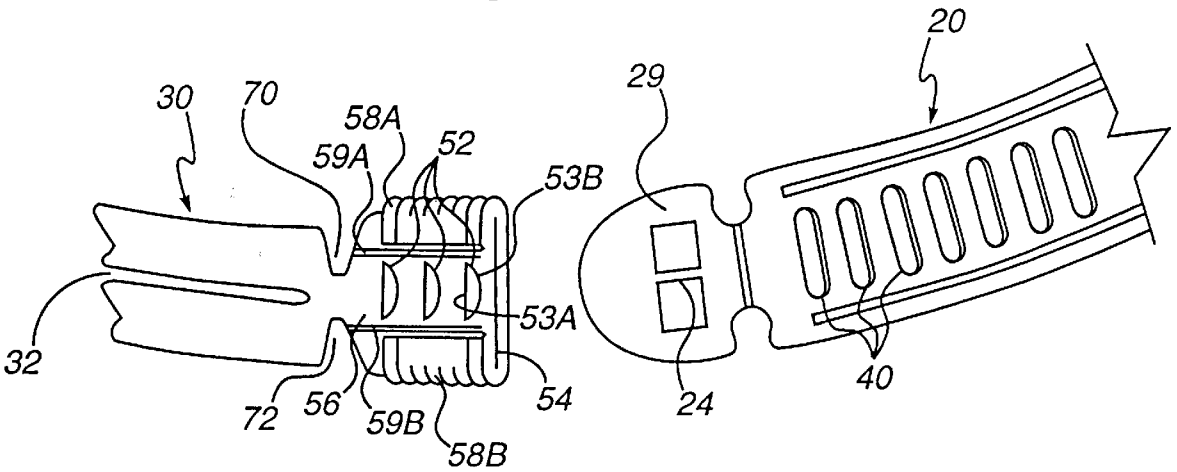
FIG. 3 illustrates a front view of the first end and the second end of the headband disconnected from each other.

In that regard, first end 20 preferably comprises a plurality of longitudinally spaced slots 40 as best illustrated in FIGS. 2 and 3. Second end 30 preferably comprises a fastener 50 which cooperates with spaced slots 40 to form an adjustable overlapping connection between first end 20 and second end 30. Fastener 50 preferably comprises at least one flange 52 dimensioned to seat in and form a locking connection with one of slots 40 to create an overlapping connection between first end 20 and second end 30. Preferably, a plurality of flanges 52 are provided to form a locking connection with an equal number of slots 40. Flanges 52 are thus preferably longitudinally spaced in the same manner as slots 40.

Figure 4:
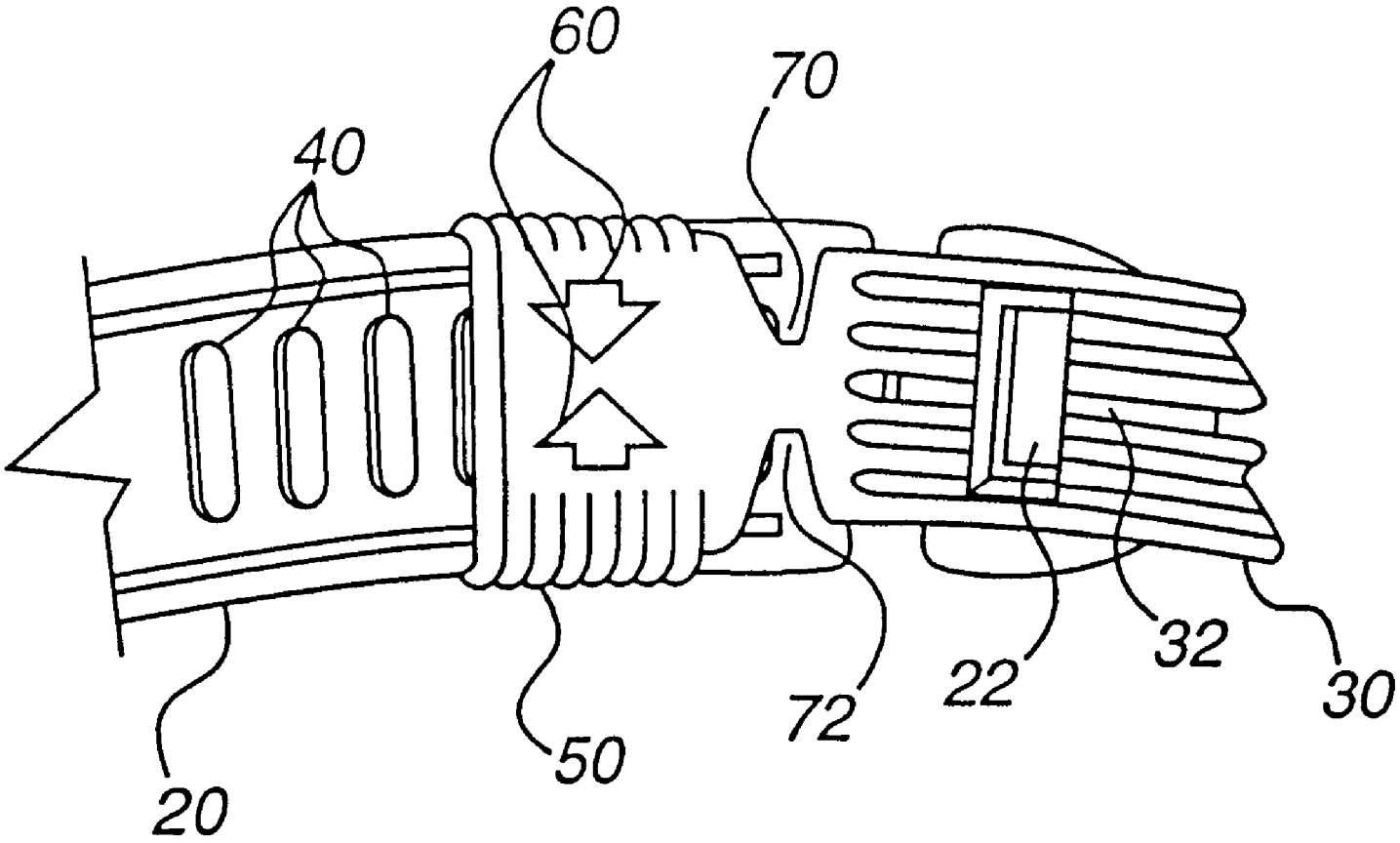
FIG. 4 illustrates the first end and the second end of the headband in overlapping connection.

Second end 30 preferably further comprises a longitudinally extending guide slot 32 which cooperates with a guide lug 22 on first end 20 to assist in guiding the slide of first end 20 and second end 30 relative to each other. Guide lug 22 preferably comprises a stem portion 24 (see FIG. 4) which slides in slot 32 and a head or flange member 26 which extends above and below slot 32. Flange member 26 preferably projects far enough above back surface 28 of first end 20 to permit a finger of the user to move it along slot 32 to assist in adjusting the fit of band 10.

Figure 5:
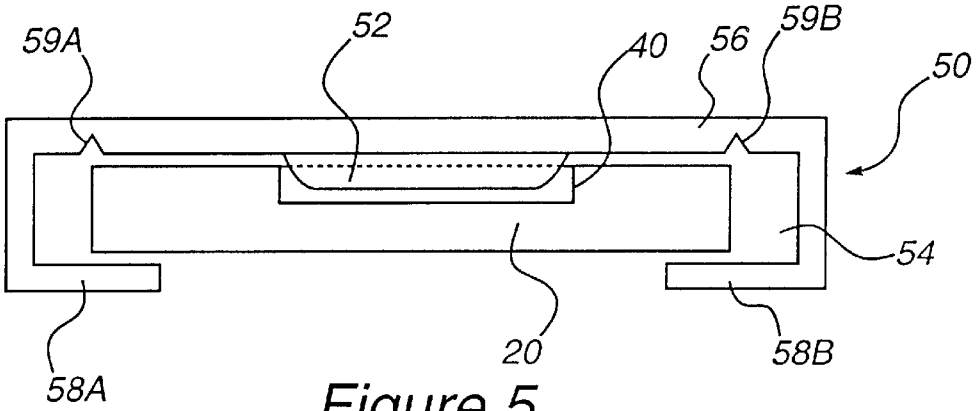
FIG. 5 illustrates a front, cross-sectional view of one flange of the fastener seated in one slot of the first end.

Fastener 50 comprises an opening, preferably a channel 54, through which first end 20 passes to form a connection with fastener 50. As illustrated in FIG. 5, channel 54 is preferably, generally C-shaped and dimensioned to allow first end 20 to be slidably retained therein. Flanges 52 extend from a surface 56 into channel 54 to engage and be seated in slots 40. Retaining flanges 58A and 58B contact front surface 29 of first end 20 to slidably retain first end 20 within channel 54 of fastener 50.

Figure 7:
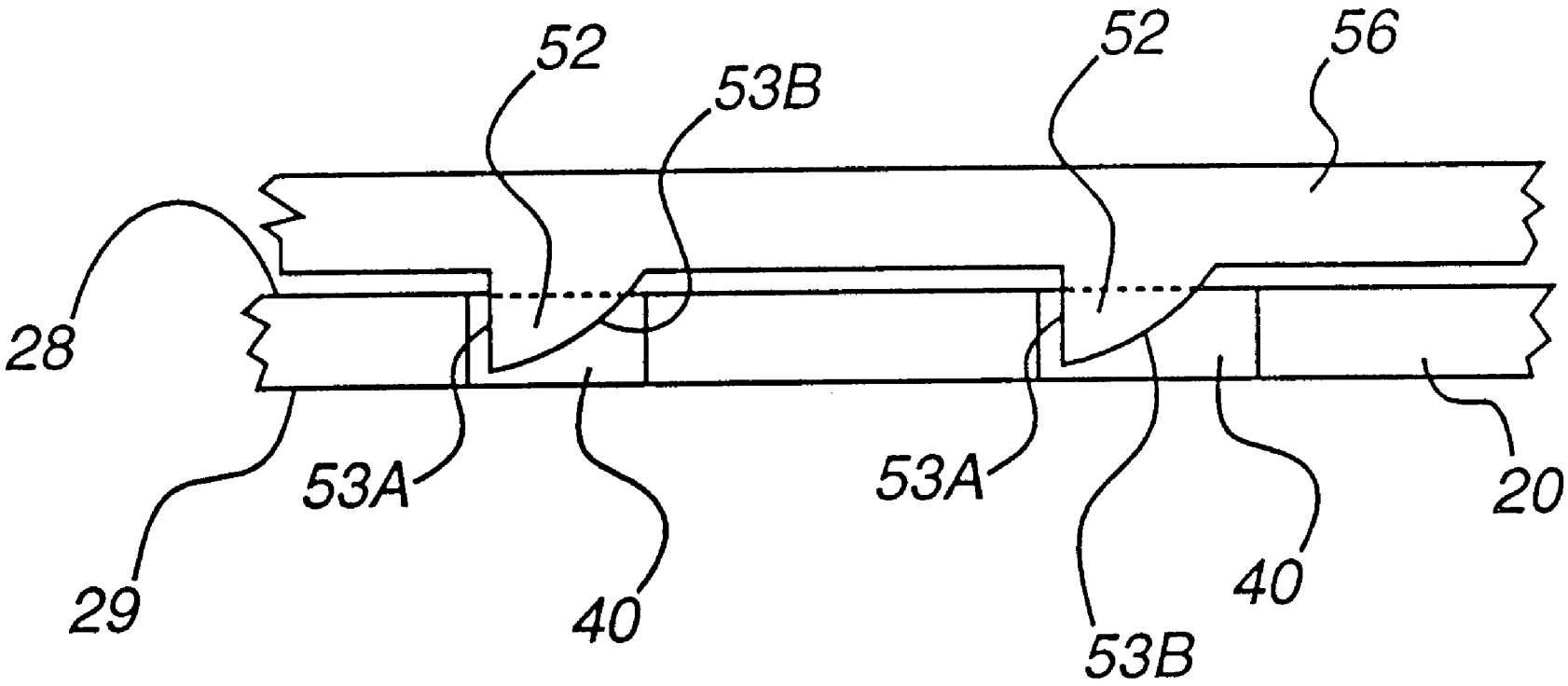
FIG. 7 illustrates a side, cross-sectional view of the seating of two flanges of the fastener in two slots of the first end.

As best illustrated in FIG. 7, flanges 52 preferably comprise a first surface 53A which is generally perpendicular to rear surface 28 of first end 20 and parallel to the orientation of slots 40 through first end 20. Flanges 52 also preferably comprise a second surface 53B that is curved or beveled. First surface 53A preferably faces the direction that fastener 50 must be slid to loosen the fit of band 10 (that is, that direction which decreases the amount of overlap between first end 20 and second end 30), while beveled or curved surface 53B faces the direction that fastener 50 must be slid to tighten the fit of band 10. Consequently, the projection of first surface 53A of flanges 52 into slots 40 provides substantial resistance to loosening of band 10, but beveled or curved second surfaces 53B allows fastener 50 to be relatively easily slid in the direction required to tighten the fit of band 10 on the head of the user.

Assuming band 10 is expanded to its largest circumference, which means that guide lug 22 is at or near the end of guide slot 32, band 10 is placed on the head of the user. The user then grips the top and bottom of fastener 50 with one hand and slides fastener 50 along first end 20 (see FIG. 1) as the user pulls guide lug 22 along second end 30 with the user's other hand. First end 20 and second end 30 are thereby slid relative to each other to increase the overlap therebetween until a desirable fit is obtained. The seating of flanges 52 in slots 40 as described above substantially prevents undesirable loosening of band 10 when in this position. This enables the band 10 to be adjusted without removing the helmet from the user's head.

Figure 6:
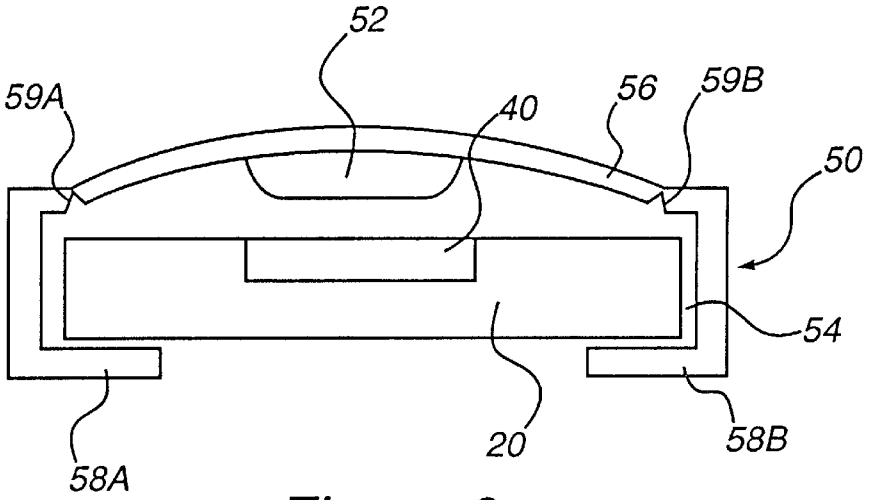
FIG. 6 illustrates a front, cross-sectional view of compression of the fastener of FIG. 5 to cause bowing of a surface thereof to unseat the flanges thereof from the slots of the first end to enable relative sliding of the fastener and the first end.

To loosen or enlarge band 10 for any reason, fastener 50 is pinched or compressed latitudinally or vertically (that is, in the direction of arrows 60 illustrated in FIGS. 2 and 4), which causes surface 56 to bow away from back surface 28 of first end 20. As better illustrated in FIG. 6, fastener 50 is dimensioned such that when it is compressed surface 56 bows sufficiently that flanges 52 are withdrawn from their seating in slots 40. Upon such bowing of fastener surface 56, band 10 can be expanded, for example, by pushing lug guide 22 to the right and/or by pulling first end 20 to the right, which will move freely through temporarily deformed fastener 50. When the compressive force is removed from fastener 50, surface 56 will flatten and flanges 52 will seat in slots 40 to prevent further enlargement of the circumference of band 10.

To facilitate the bowing of surface 56 and allow enlargement of band 10 during the compression of fastener 50, second end 30 is preferably provided with at least one inwardly extending notch 70. Preferably, two notches 70 and 72 are provided which extend latitudinally inward (toward the center of second end 30). One notch 70 preferably extends downward from the top of second end 20, and another notch 72 preferably extends upward from the bottom of second end 20. Notches 70 and 72 are preferably located opposite each other and adjacent fastener 50. The present inventors have discovered that placing notches 70 and 72 adjacent fastener 50 essentially isolates fastener 50 from the remainder of band 10 during the compression of fastener 50 and increases the bowing of surface 56 to unseat flanges 52 and enlarge the circumference of band 10. Absent notches 70 and 72, the user would have to compress a substantial portion of band 10 to bow surface 56 sufficiently to unseat flanges 52. Notches 70 and 72 are preferably positioned as closely to fastener 50 as possible to minimize that portion of band 10 that is compressed.

Moreover, to effectively isolate fastener 50 from the remainder of second end 30 and thus band 10, notches 70 and 72 preferably extend inwardly (that is, toward the center of second end 30) a sufficient distance such that substantially no compression of second end 30 on the side of notches 70 and 72 opposite the location of fastener 50 is required to unseat flanges 52 from slots 40. In the embodiment illustrated in FIGS. 3 and 5, fastener 50 further comprises at least one plastic hinge 59A which facilitates bowing of surface 56. Preferably, two hinges 59A and 59B are provided. Hinges 59A and 59B may be simply formed as longitudinally extending notches in surface 56 to facilitate bowing. In this embodiment, notch 70 preferably extends inwardly past hinge 59A, while notch 72 preferably extends inwardly beyond hinge 59B.

Figure 8:
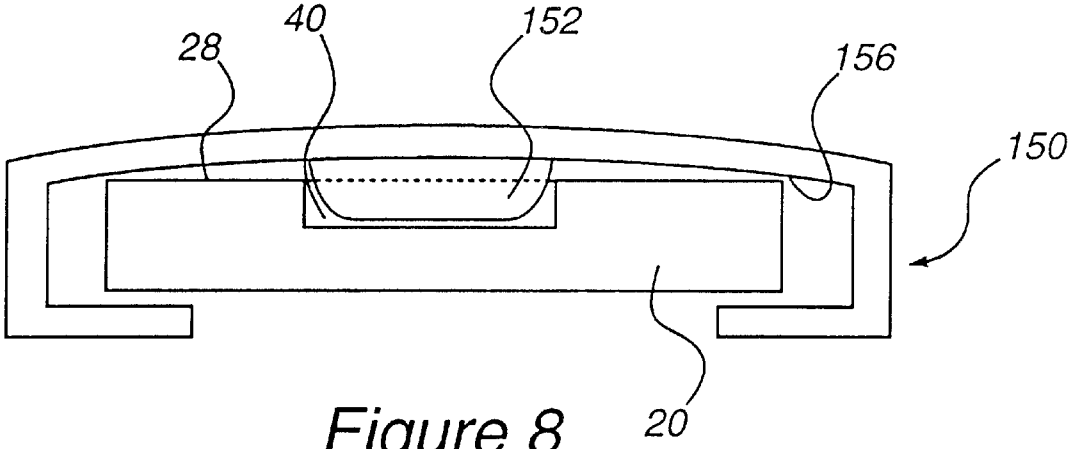
FIG. 8 illustrates a front, cross-sectional view of another embodiment of a fastener of the present invention.
Figure 9:
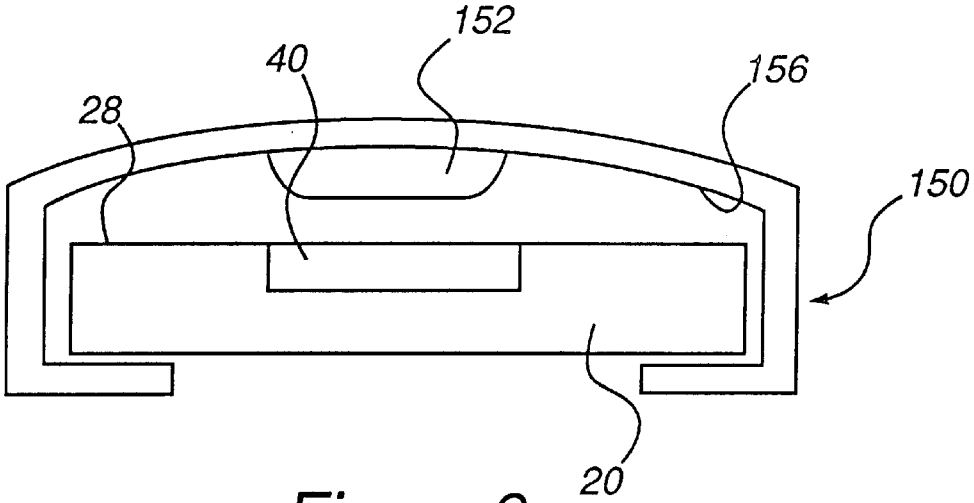
FIG. 9 illustrates a front, cross-sectional view of compression of the fastener of FIG. 9 to cause bowing of a surface thereof to unseat the flanges thereof from the slots of the first end to enable relative sliding of the fastener and the first end.

In another embodiment illustrated in FIGS. 8 and 9, facilitation of bowing can be accomplished without the use of plastic hinges by providing a fastener 150 comprising flanges 152 extending from an arched surface 156. Surface 156 arches away from back surface 28 of first end 20. The arching of surface 156 away from back surface 28 of first end 20 facilitates the unseating of flanges 152 from slots 40 upon application of a compressive force to fastener 150 as described above (see FIG. 9).

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A flexible headband comprising a first end and a second end which overlap, the first end comprising a plurality of longitudinally spaced attachment members, the second end having a resilient fastener comprising an opening to slidably receive the first end in overlapping engagement, the fastener comprising a fastener surface, the fastener surface comprising at least one cooperating attachment member adapted to form a releasable engagement with one of the plurality of attachment members of the first end, the fastener surface being resiliently bowable in a direction away from the first end upon application of a compressive force to the fastener, whereby the at least one cooperating attachment member is disengagable from the one of the attachment members of the first end to which it is engaged so that the first end can be moved relative to the fastener, the second end further comprising an area of reduced width adjacent the fastener to isolate the fastener from a remainder of the second end during bowing of the fastener surface to disengage the at least one cooperating attachment member, thereby facilitating bowing of the fastener surface to disengage the at least one cooperating attachment member.

2. The flexible headband of claim 1 wherein each of the attachment members of the first end comprises a retention region and the at least one cooperating attachment member of the fastener surface comprises a protrusion to engage and be retained by one of the retention regions.

3. The flexible headband of claim 2 wherein the retention regions comprise recesses.

4. The flexible headband of claim 2 wherein the retention regions comprise slots.

5. The flexible headband of claim 1 wherein the area of reduced width comprises a latitudinally inward extending first notch adjacent the fastener.

6. The flexible headband of claim 5 wherein the area of reduced width further comprises a latitudinally inward extending second notch adjacent the fastener, the first notch and the second notch being opposite each other.

7. The flexible headband of claim 1 wherein the fastener further comprises a first hinge positioned generally longitudinally thereon.

8. The flexible headband of claim 7 wherein the first hinge is positioned latitudinally outward with respect to the area of reduced width.

9. The flexible headband of claim 6 wherein the fastener further comprises a pair of hinges, each one positioned generally longitudinally thereon.

10. The flexible headband of claim 9 wherein the first notch extends latitudinally inward into the fastener past the first hinge and the second notch extends latitudinally inward into the fastener past the second hinge.

11. The flexible headband of claim 10 wherein the pair of hinges comprise longitudinally extending notches in the fastener surface.

12. In a flexible headband having a first end and a second end which overlap, the first end including several slots, and the second end having a fastener which can slidably receive the first end in overlapping engagement and which has several protrusions which can be releasably engaged and retained in the slots, the improvement comprising a first inwardly extending notch adjacent to the fastener to isolate the fastener from a remainder of the second end during bowing of the fastener, thereby making the fastener more easily bowable in a direction away from the first end upon application of a compressive force to the fastener such that the protrusions are displaceable from the slots in which they are retained so that the first end can be moved relative to the fastener.

13. The flexible headband of claim 12 wherein the second end further comprises a second inwardly extending notch adjacent the fastener to facilitate bowing of the fastener surface upon application of the compressive force.

14. The flexible headband of claim 13 wherein the first notch and the second notch are opposite each other and extend latitudinally inwardly.

15. The flexible headband of claim 12 wherein the fastener further comprises a hinge positioned generally perpendicular to the first inwardly extending notch.

16. The flexible headband of claim 15 wherein the first notch extends inwardly into the second end past the first hinge.

17. The flexible headband of claim 13 wherein the fastener further comprises a pair of hinges, each one positioned generally perpendicular to the first and second inwardly extending notches.

18. The flexible headband of claim 17 wherein the first notch extends inwardly into the second end past the first hinge and the second notch extends inwardly into the second end past the second hinge.

19. The flexible headband of claim 18 wherein the pair of hinges comprise longitudinally extending notches in the fastener surface.

* * * * *